US006138739A

United States Patent [19]

Crider et al.

[11] Patent Number: 6,138,739

[45] Date of Patent: Oct. 31, 2000

[54] PORTAL COVERING

[75] Inventors: Grant W. Crider, 1743 County Rd. 68, Bremen, Ala. 35033; Charles H. Harbison, Birmingham, Ala.

[73] Assignee: Grant W. Crider, Bremen, Ala.

[21] Appl. No.: 09/232,560

[22] Filed: Jan. 15, 1999

[51] Int. Cl.[7] ..... A47G 5/02

[52] U.S. Cl. ..... 160/273.1; 160/85

[58] Field of Search ..... 160/273.1, 85, 160/268.1, 86, 120, 121.1, 242, 243, 66, 270, 271, 310

[56] References Cited

U.S. PATENT DOCUMENTS

| | | |
|---|---|---|
| 1,113,721 | 10/1914 | Watson . |
| 1,309,488 | 7/1919 | Richardson . |
| 2,281,022 | 4/1942 | Cavanaugh . |
| 2,349,368 | 5/1944 | Myers . |
| 3,279,528 | 10/1966 | Gambon et al. . |
| 3,464,480 | 9/1969 | Kuss . |
| 3,789,904 | 2/1974 | Takazawa . |
| 3,980,122 | 9/1976 | Takazawa . |
| 4,326,577 | 4/1982 | Tse . |
| 4,344,473 | 8/1982 | Shore . |
| 4,344,474 | 8/1982 | Berman . |
| 4,418,739 | 12/1983 | Woolnough et al. . |
| 4,436,137 | 3/1984 | Charles . |
| 4,453,584 | 6/1984 | Steele . |
| 4,473,101 | 9/1984 | Langeler . |
| 4,574,864 | 3/1986 | Tse . |
| 4,649,981 | 3/1987 | Bibeau . |
| 4,744,403 | 5/1988 | Hausmann et al. . |
| 5,141,044 | 8/1992 | Hying et al. . |
| 5,195,594 | 3/1993 | Allen et al. . |
| 5,524,693 | 6/1996 | Hamilton . |
| 5,535,806 | 7/1996 | Kold et al. . |
| 5,566,736 | 10/1996 | Crider et al. . |

*Primary Examiner*—David M. Purol
*Attorney, Agent, or Firm*—Veal & Associates

[57] ABSTRACT

An improved roll-up closure utilizing a flexible cover selected from a material suitable to effect the type of closure sought. The cover is at least as wide as the portal to be covered and is typically longer than the portal. Each lateral margin of the cover has a strip of hook or loop fastener material affixed thereto, with the complementary strip affixed to either the respective lateral margin defining the portal or to a "floating" edge of an elongated strip of flexible material attached at its opposite edge to the respective lateral margin. A first end of the cover is rigidly affixed across a first margin of the portal. The opposite end of the cover can be upturned about a transverse rod and connected to a take-up roller mounted adjacent the first margin of the portal, or it can be attached to the rod such that as the cover is raised or lowered, the cover is wound or unwound around the rod. Channel members prevent movement of the rod in a direction normal to the plane of the portal. Activation of the take-up roller lengthens or shortens the effective length of the cover while positioning the fasteners to seal or unseal the cover to the lateral margins of the portal or to the elongated strips attached thereto. The rod has a spring loaded roller on each end which engages an angled surface within each channel member to bias the rod toward the portal to effect a proper seal.

34 Claims, 12 Drawing Sheets

PORTAL COVERING

FIELD OF THE INVENTION

The present invention relates to closures for windows, doors, or other portals. In greater particularity, the present invention relates to a non-sliding, roll-up closure for a portal.

BACKGROUND OF THE INVENTION

Various applications are known wherein a portal requires a closure, or cover, to prevent the passage of wind, rain, light, insects, or any other elements through the portal. As used herein, portal simply means an opening which would allow the passage of such elements therethrough; hence, a portal may be a window or doorway and the closure of the instant invention may control the passage of any of the above elements therethrough. The present invention addresses the need for improved closures for portals such as may be found on residence houses, pool houses, green houses, livestock houses, warehouses, patios, atriums or any other similar structures. The portal may be as small as would accommodate a ventilation fan in a gymnasium or livestock house, or as large as an atrium wall in a solar efficient building or an inclined roof panel. Additionally, the portal can have substantially any shape, such as round or rectangular, and the position of the portal can range from vertical to horizontal or any angle therebetween.

SUMMARY OF THE PRESENT INVENTION

It is an object of the present invention to provide a portal covering useful in numerous types of structures.

It is another object of the present invention to provide a flexible portal covering having a strong, reliable seal.

These and other objects of the present invention are accomplished through the use of an improved roll-up closure utilizing a flexible cover selected from a material suitable to effect the type of closure sought. The cover is at least as wide as the portal to be covered and is typically longer than the portal. Each lateral margin of the cover has a strip of hook or loop fastener material affixed thereto, with the complementary strip affixed to either the respective lateral margin defining the portal or to a "floating" edge of an elongated strip of flexible material, which is attached to the respective lateral margin at its opposite edge. A first end of the cover is rigidly affixed across a first margin of the portal. The opposite end of the cover can be upturned and connected to a driven take-up roller mounted adjacent the first margin of the portal. In this embodiment, an elongated transverse rod is supported within the upturned end of the cover. In an alternate embodiment, the opposite end of the cover is attached to the elongated transverse rod such that as the curtain is raised or lowered, the curtain is respectively wound or unwound around the rod. In either embodiment, activation of the driven roller lengthens or shortens the effective length of the cover while positioning the mating hook and loop fasteners to seal or unseal the cover to the lateral margins of the portal or to the elongated strips attached thereto. Channel members allow the rod to travel in a direction parallel to the plane of the portal but prevent movement normal thereto. The rod preferably has a spring loaded roller on each end which engages an angled surface in the channel member to bias the rod toward the portal to effect a proper seal.

These and other objects and advantages of the invention will become apparent from the following detailed description of the preferred embodiment of the invention.

BRIEF DESCRIPTION OF THE DRAWINGS

A closure embodying features of the invention is described in the accompanying drawings which form a portion of this disclosure and wherein.

DETAILED DESCRIPTION OF THE PREFERRED EMBODIMENT

Figure 1:
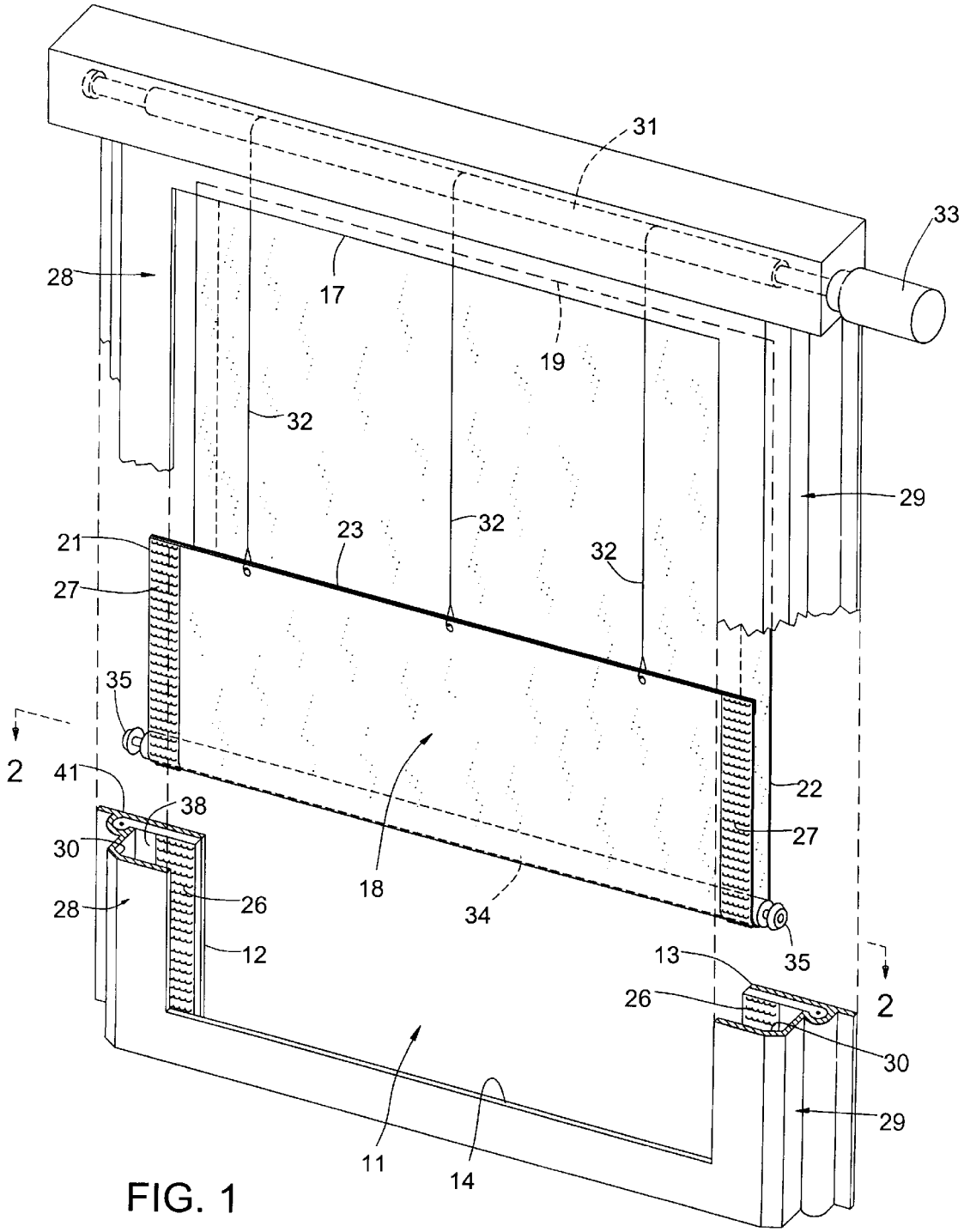
FIG. 1 is a perspective view of the invention in a partially raised position and shown partially in section.
Figure 2:
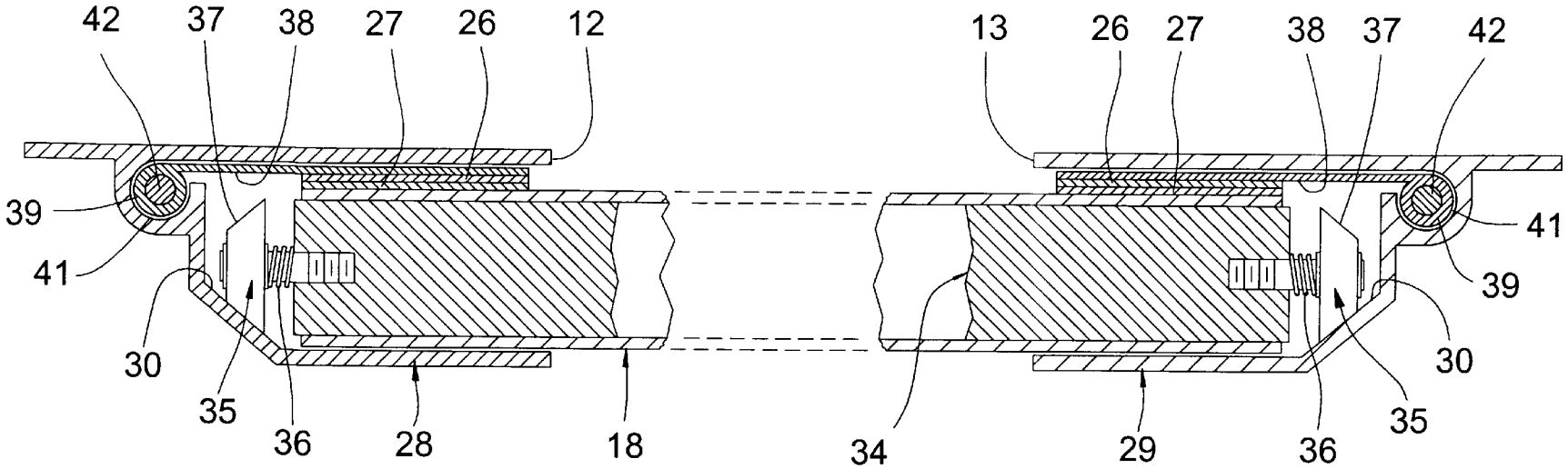
FIG. 2 is a sectional view taken along line 2—2 of FIG. 1.
Figure 3:
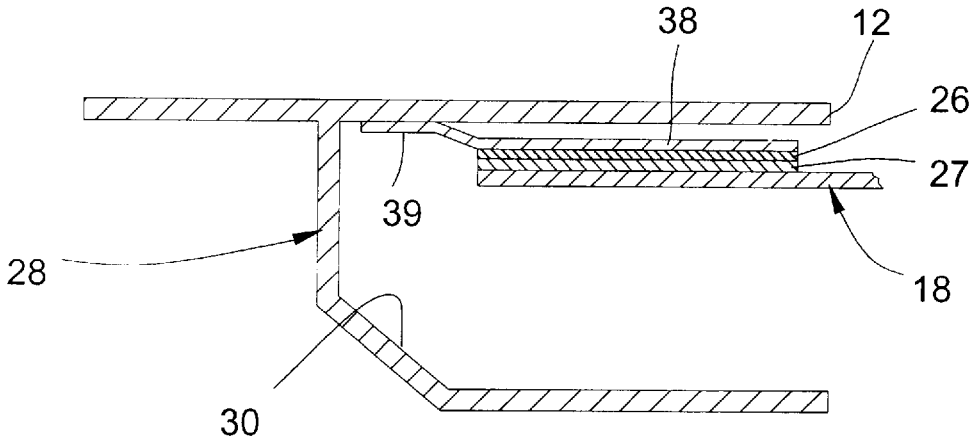
FIG. 3 is a detailed sectional view of an alternate channel member of the invention.
Figure 4:
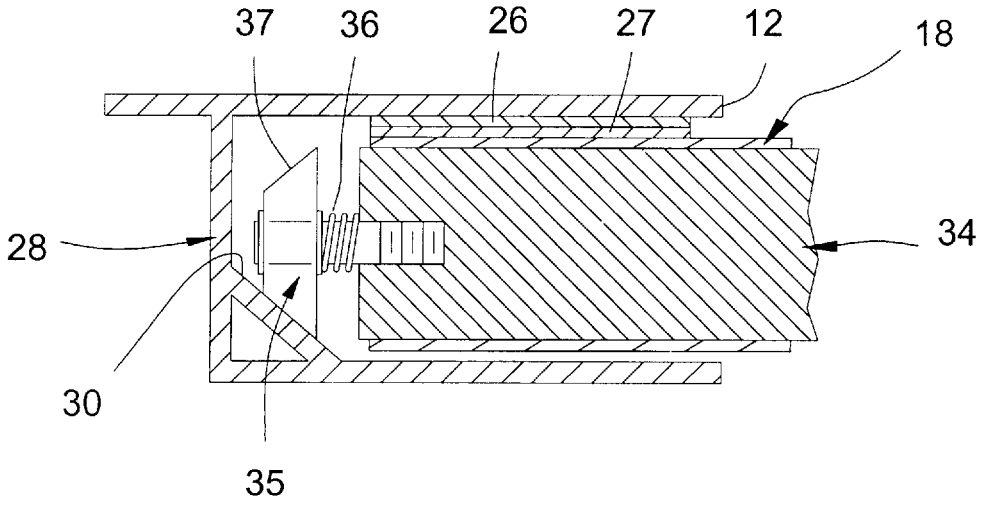
FIG. 4 is a detailed sectional view of an alternate channel member of the invention.

The invention disclosed herein is technology related to U.S. Pat. Nos. 5,566,736, 5,752,557, and 5,785,105, all of which are incorporated herein by reference. A more complete understanding of the invention may be obtained by reference to the accompanying drawings wherein the closure, according to the preferred embodiment, covers an opening 11 having a pair of lateral margins 12 and 13. Margins 12 and 13 extend the full vertical length of opening 11 and may terminate at a lower margin 14, which extends across the width of the opening. Across the top of opening 11 is an upper margin 17 which extends from margin 12 to margin 13. Thus, it may be seen that the opening is completely framed by margins 12, 13, 14, and 17. It is to be understood that the present invention may be positioned vertically, horizontally, or inclined, thus the terms lower or upper margin do not imply only vertical disposition of the unit.

Attached to margin 17 is a first end of a curtain 18, the curtain being comprised of a flexible material selected in accordance with the purposes of the present invention for its ability to block or transmit light, air, moisture, insects, or the like from one side to the other thereof. Therefore, curtain 18 is properly defined as a flexible barrier material, having a first end 19 secured to margin 17 and opposing longitudinal sides 21 and 22, which are longer than the length of margins 12 and 13, and a lower end 23. Attached to margins 12 and 13 and to sides 21 and 22 are complementary closure members 26 and 27, such as hook and loop fastener material, which can be selectively attached and detached. Note that the closure members need only be approximately commensurate in length with the length of the margins, thus end 23 of curtain 18 does not need the fastener material. A transverse closure (not shown) may be provided in conjunction with lower margin 14; however, on a door, margin 14 would not be present.

As illustrated in FIG. 1, end 23 may be connected to a transverse take-up pipe 31 mounted for rotation above the tops of margins 12 and 13 by cables or straps 32 or, alternatively, end 23 may be directly connected to pipe 31. In any case, pipe 31 is driven by a reversible motor 33 attached to a selected means of control (not shown) and supports end 23. An elongated rod 34, which may be a solid or tubular pipe, is supported within a pocket created by upturned end 23 such that rod 34 is lifted within the pocket as pipe 31 is rotated to wrap the straps 32 thereabout and raise the curtain. Rod 34 preferably has sufficient weight to maintain the curtain taut. Lateral margins 12 and 13 have channel members 28 and 29 attached thereto for receiving opposing ends of rod 34 therein, thus preventing the curtain from being pulled away from the portal. Alternatively, channel members 28 and 29 can form lateral margins 12 and 13 of the portal. Thus, lateral margins 12 and 13 are sometimes described and illustrated as portions of channel members 28 and 29. Channel members 28 and 29 each have a surface 30 angled towards lateral margins 12 and 13 for engaging the ends of rod 34 to bias rod 34 towards the lateral margins, wherein the angled surfaces 30 extend the vertical length of channel members 28 and 29. Each end of rod 34 preferably has a spring loaded roller 35 thereon for engaging the angled surfaces 30 of channel members 28 and 29. Each roller 35 preferably has a tapered surface 37 corresponding to the respective angled surface 30 engaged.

As pipe 31 unwraps the curtain 18 or straps 32 from itself, gravity urges rod 34 and curtain 18 to a lowered position. Curtain sides 21 and 22 carrying closure members 27 are pressed against complementary closure members 26 attached to lateral margins 12 and 13 as a result of rod 34. As rod 34 moves towards a lowered position, the spring loaded rollers 35 are continually engaging the angled surfaces 30, which act to bias rod 34 towards lateral margins 12 and 13, thereby ensuring a sealing connection between closure members 26 and 27. As pipe 31 raises the curtain, the lifting force is transferred around rod 34 to provide an opening force to the closures nearly normal thereto, such that they are readily detached. From the foregoing, it is easily seen that as pipe 31 rotates, it effectively varies the length of curtain 18 such that rod 34 urges closure members 26 and 27 into sealing engagement.

In a preferred embodiment, an elongated strip 38 of a flexible material is affixed along one edge 39 to margins 12 and 13 and the unattached opposite edge has complementary closure member 26 affixed thereto rather than directly to the lateral margins. Elongated strip 38 is preferably affixed at its top and bottom edges to margins 12 and 13 (not shown) to maintain the unattached opposite edge of elongated strip 38 aligned with curtain 18 such that complementary closure members 26 and 27 are in proper alignment for sealing engagement. After the closure members 26 and 27 have been sealably engaged, the seal between the curtain and lateral margins 12 and 13 is allowed to "float". This "floating seal" provides additional strength to the closure inasmuch as it allows greater flexibility in response to mechanical abrasion or the like. In the preferred embodiment, channel members 28 and 29 are extrusions having a cavity 41 formed therein and extending the vertical length of the channel members for receiving fixed end 39 of elongated strip 38 therein. In this embodiment, fixed end 39 is preferably wrapped about a cord 42 extending the length of cavity 41.

Figure 9:
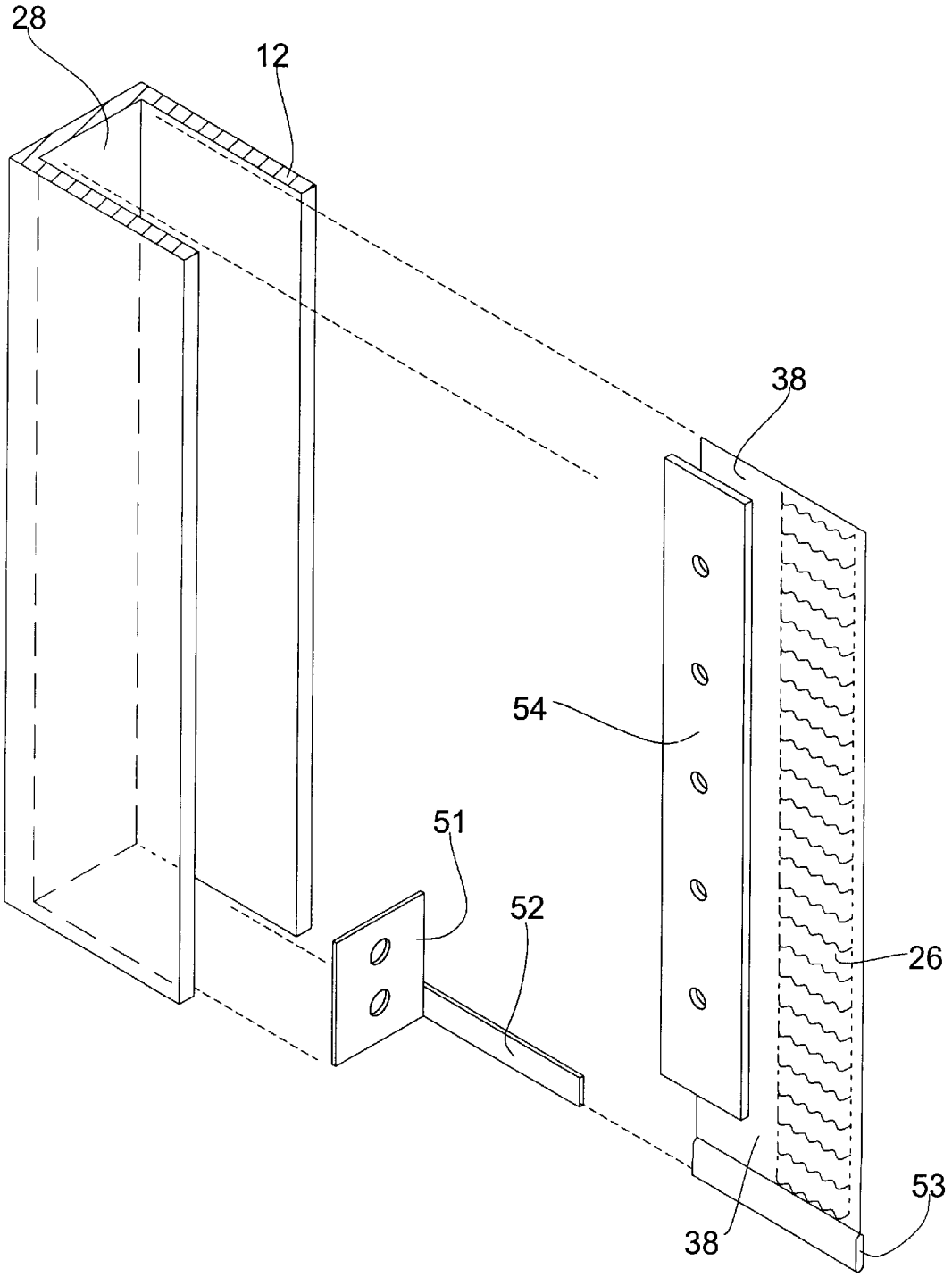
FIG. 9 is an exploded perspective view of an alternate embodiment of the floating seal and channel member.
Figure 10:
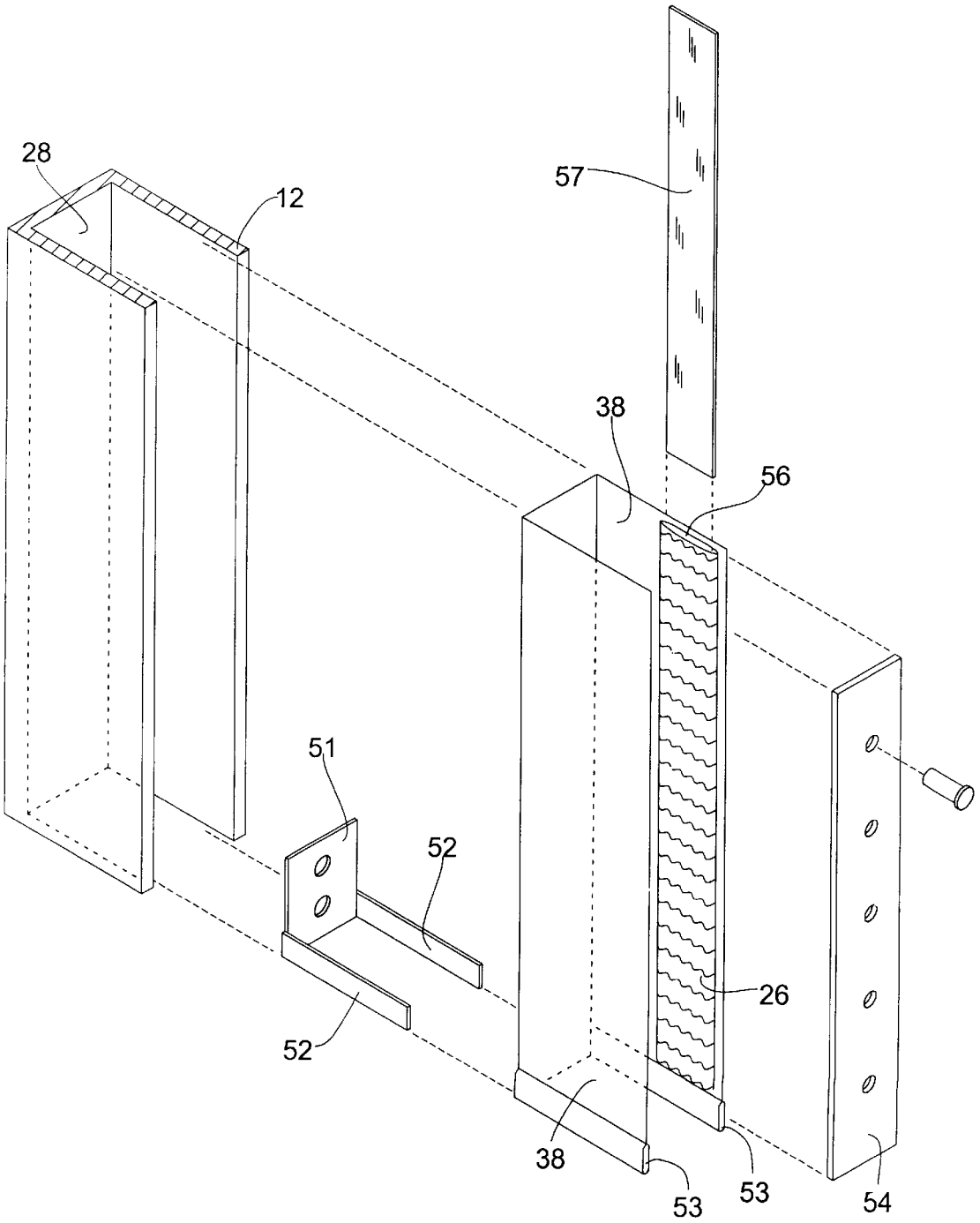
FIG. 10 is an exploded perspective view of an alternate embodiment of the floating seal and channel member.
Figure 11:
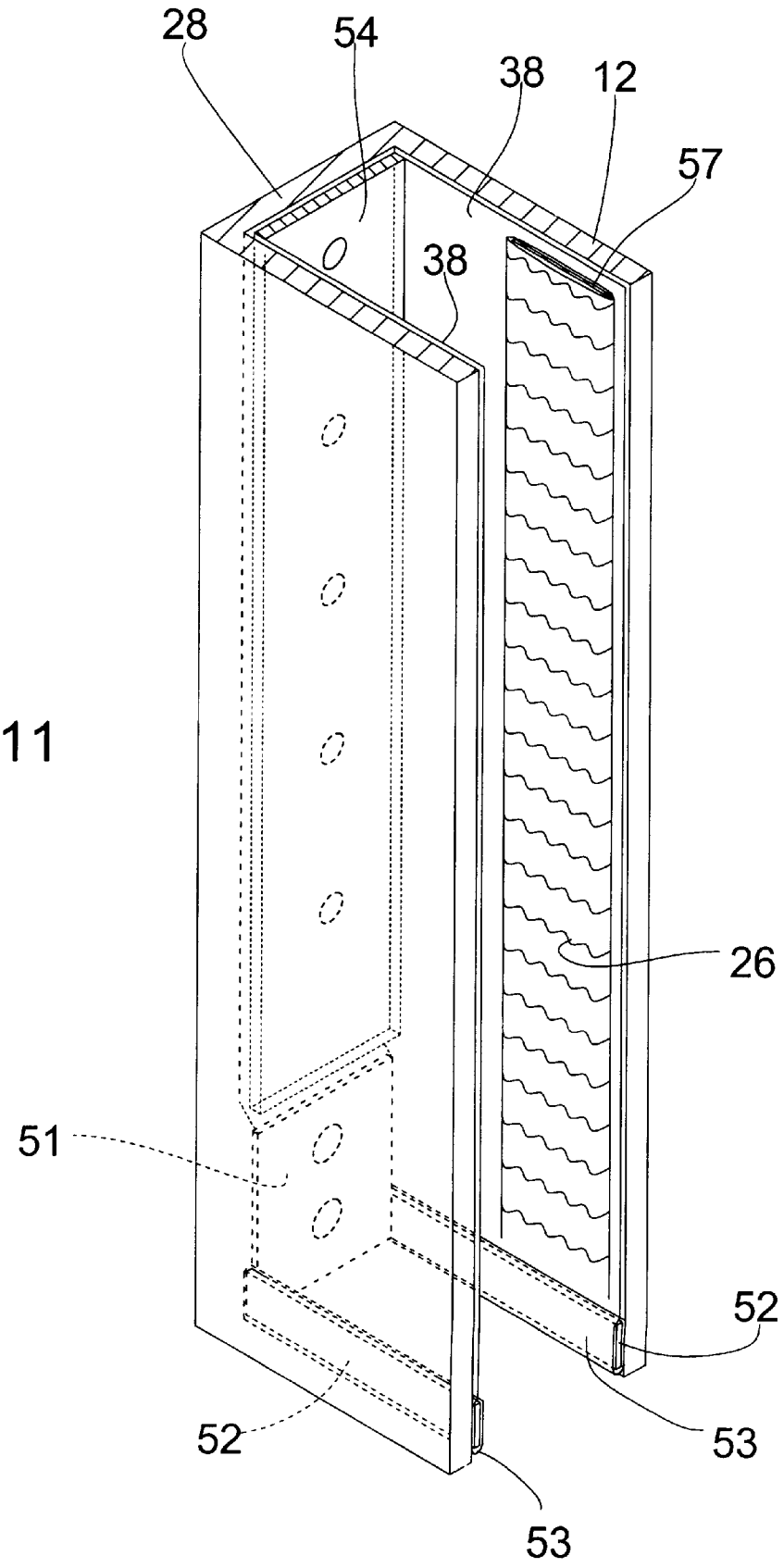
FIG. 11 is a perspective view of the embodiment of FIG. 10.
Figure 12:
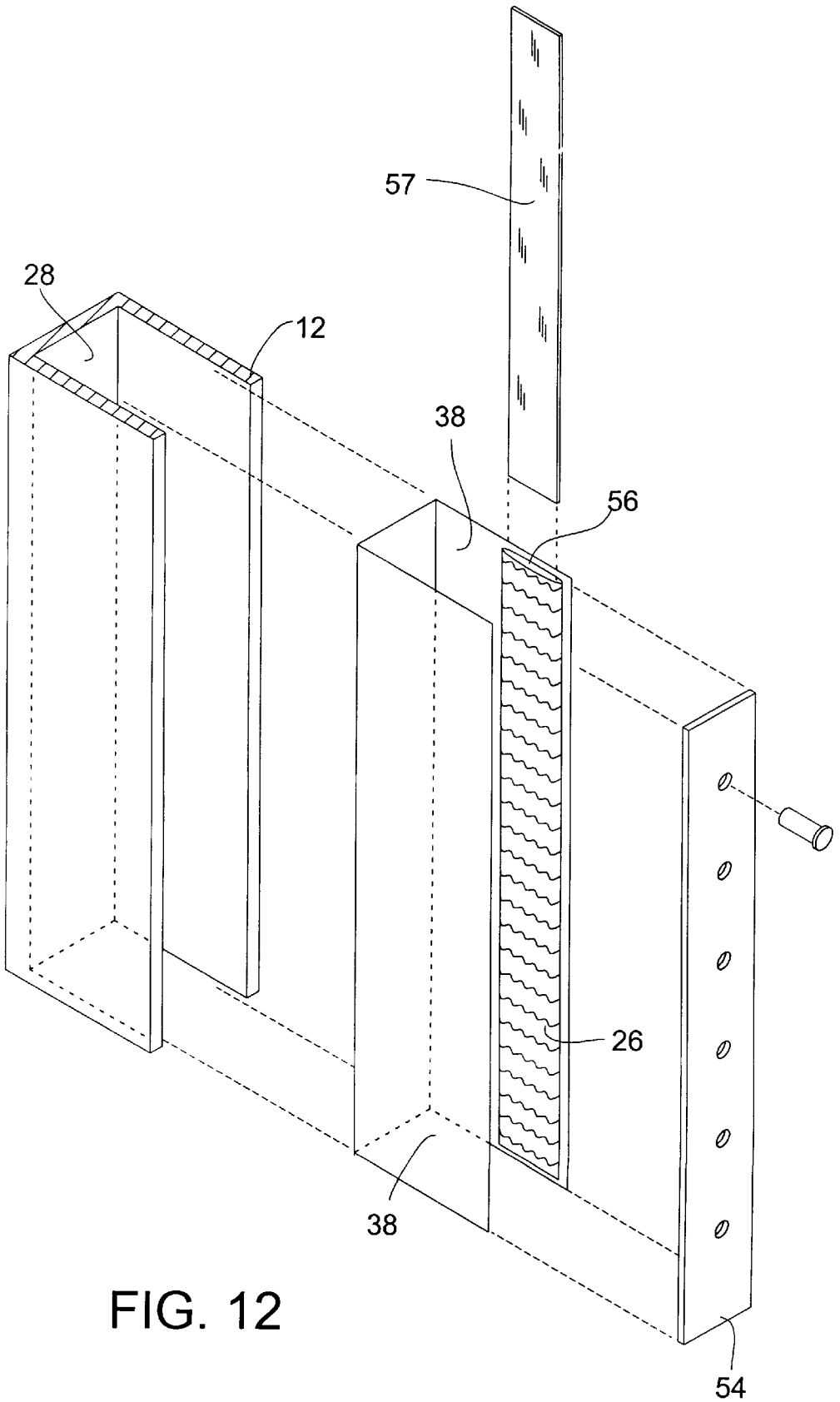
FIG. 12 is an exploded perspective view of an alternate embodiment of the floating seal and channel member; and, FIG. 13 is a perspective view of the embodiment of FIG. 12.
Figure 13:
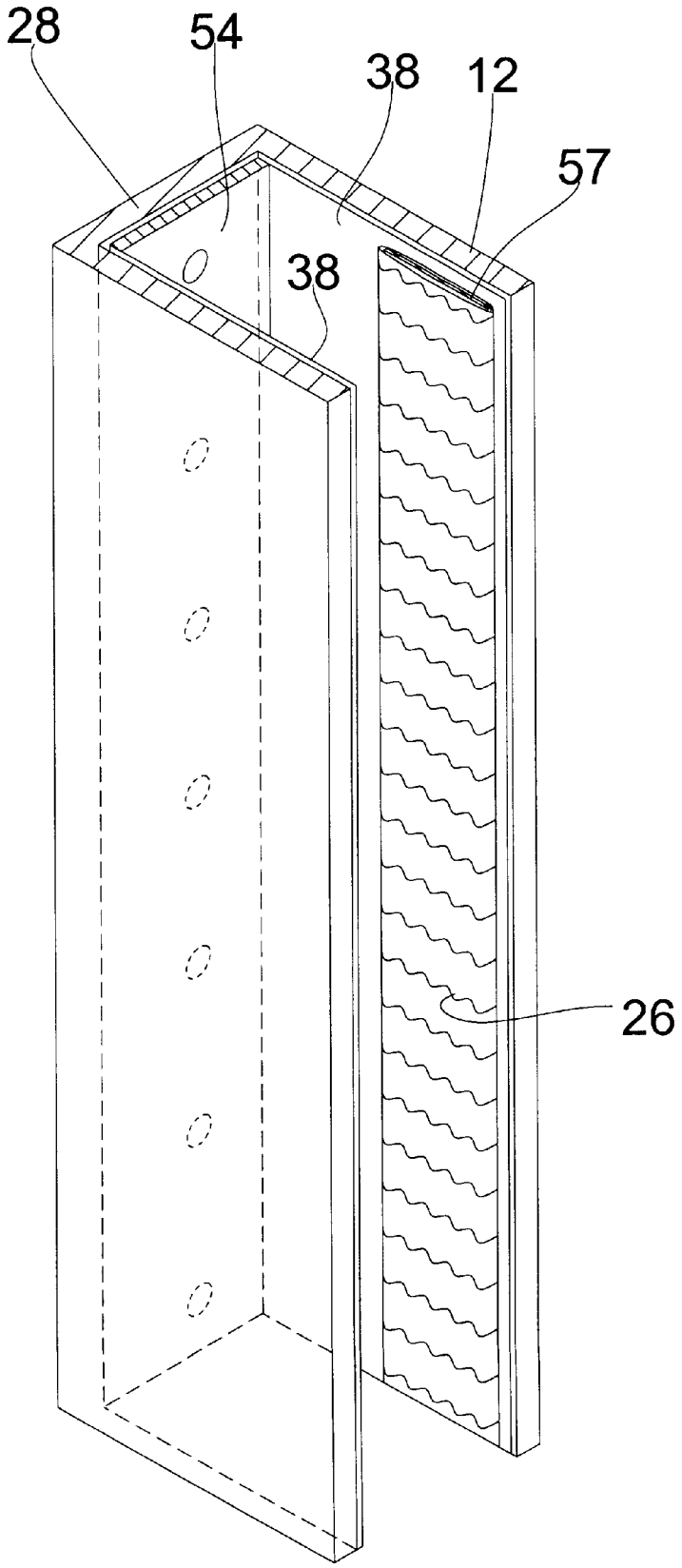

In alternate embodiments of the "floating seal" shown in FIGS. 9–11, elongated strip 38 can be attached to the upper and lower ends of channel members 28 and 29 by brackets 51 having arms 52 extending therefrom for receiving thereover pockets 53 formed along the upper and lower ends of elongated strip 38. Once elongated strip 38 is properly positioned on bracket arms 52 within channel members 28 and 29, a plate 54 is affixed over elongated strip 38 to channel members 28 and 29 to firmly hold elongated strip 38 in proper position. These embodiments facilitate replacement of elongated strip 38 and attached closure member 26 in case of damage or excessive wear. Optionally, a channel 56 can be formed between elongated strip 38 and attached closure member 26 for receiving a rigid support member 57 therein, wherein rigid support member 57 preferably comprises a lightweight metal or plastic. Rigid support member 57 is preferably inserted into channel 56 prior to placement of elongated strip 38 within channel members 28 and 29. Rigid support member 57 imparts a rigidity to elongated strip 38 and attached closure member 26 to promote detachment of closure member 26 from closure member 27 as curtain 18 is raised. In the embodiment comprising rigid support member 57, brackets 51 can be omitted, as illustrated in FIGS. 12 and 13.

Figure 5:
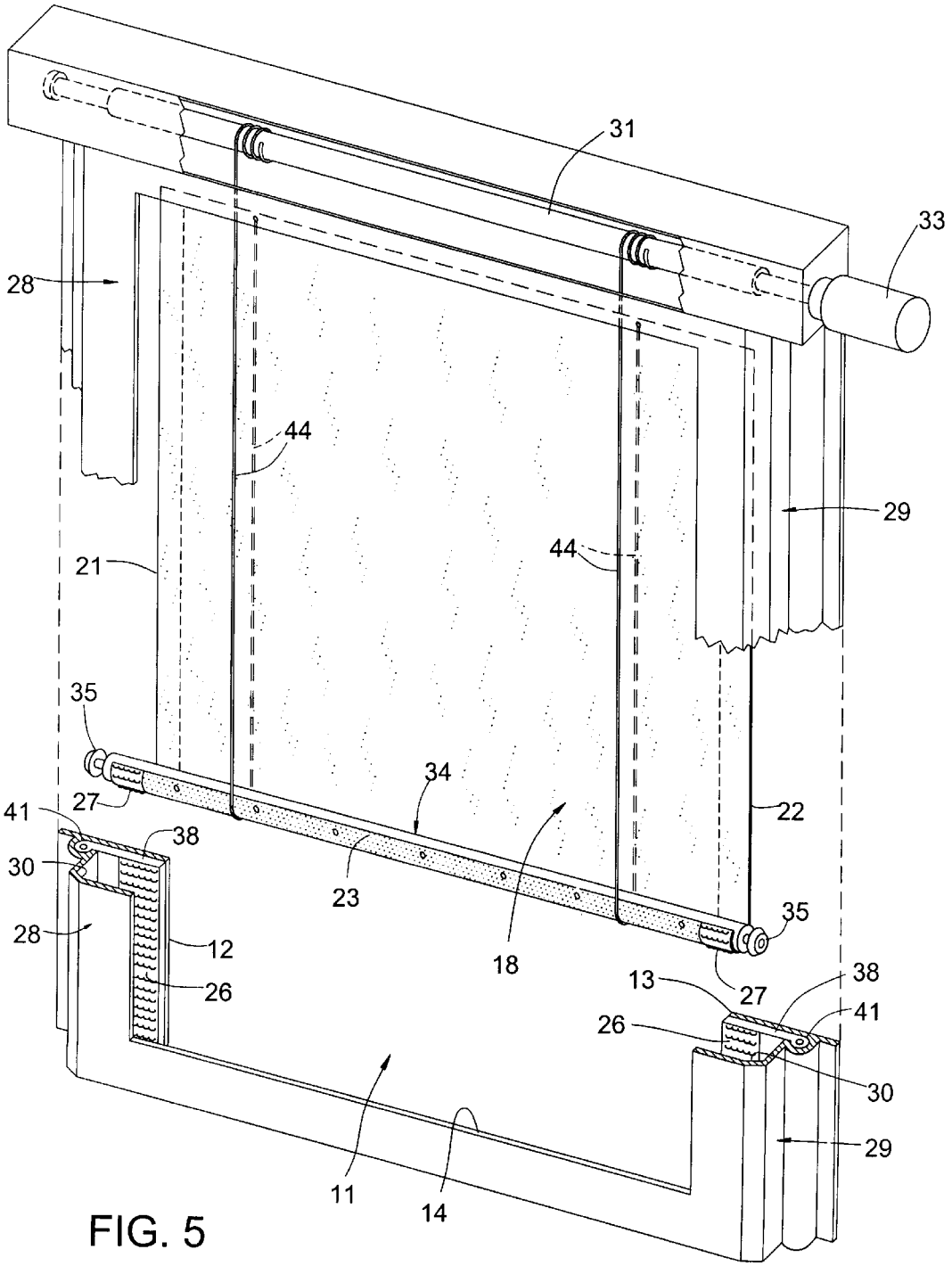
FIG. 5 is a perspective view of an alternate embodiment of the invention in a partially raised position and shown partially in section.

In an alternate embodiment of the invention shown in FIG. 5, lower end 23 of the curtain can be fixedly attached to rod 34. At least one cable 44 encircles rod 34 and is attached at one end to pipe 31 and at a second end to a point above the maximum height of rod 34 when fully raised. As pipe 31 rotates, cables 44 are wound around pipe 31, effectively shortening the length of cables 44. As a result, rod 34 is rotatably raised and the lower end of curtain 18 is wound around rod 34. In this embodiment, the spring loaded rollers 35 become critical for proper sealing of closure members 26 and 27. Specifically, as curtain 18 and rod 34 are lowered, the distance between rod 34 and lateral margins 12 and 13 decreases because curtain 18 is being unwound from rod 34, thus decreasing the collective diameter of rod 34 having curtain 18 wrapped thereon. The springs 36 act to urge rollers 35 outward from rod 34 to continuously engage angled surfaces 30, thus maintaining the biasing effect. Otherwise, the seal may become less secure as rod 34 approaches margin 14.

Figure 6:
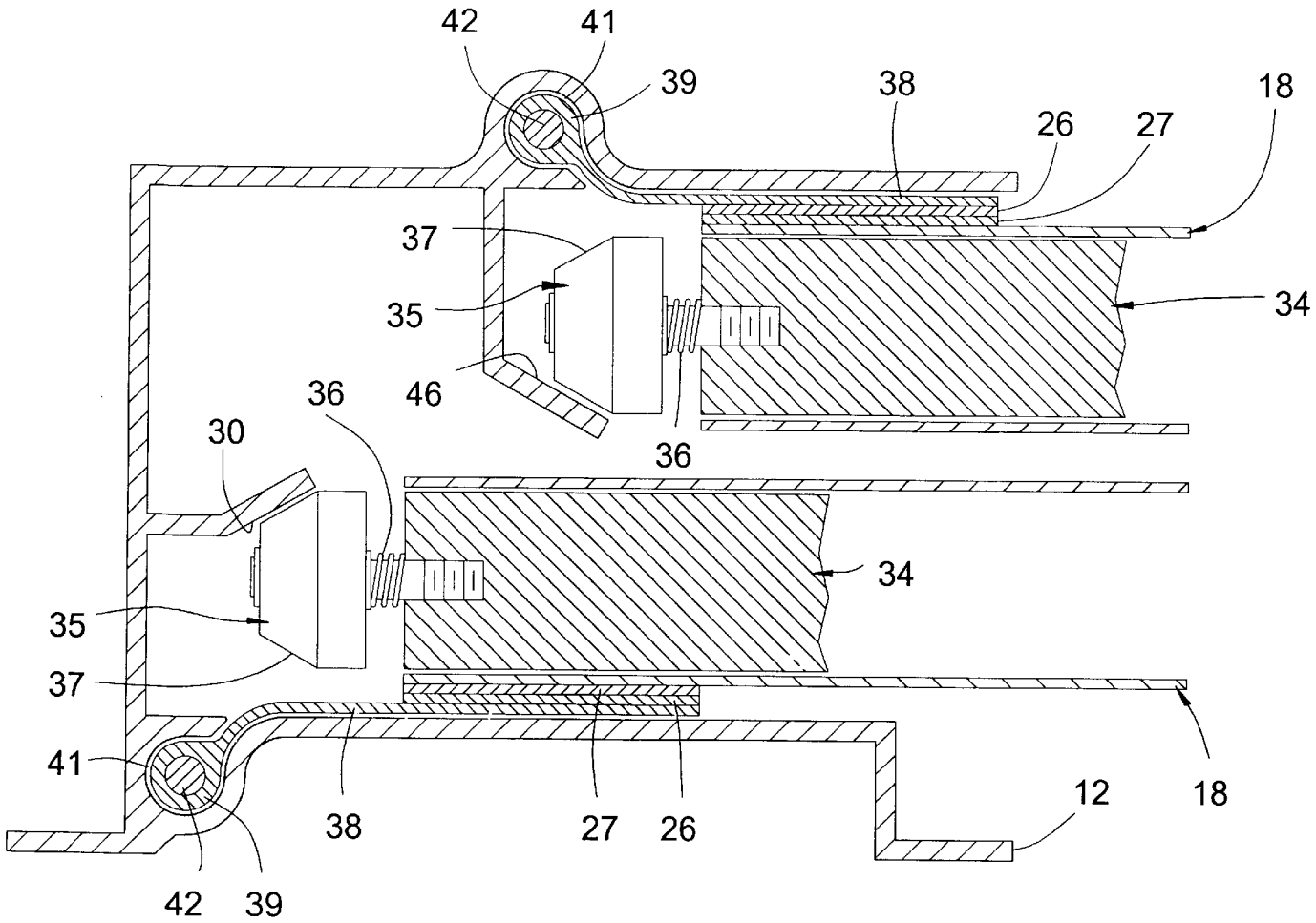
FIG. 6 is a detailed sectional view of a channel member in an alternate embodiment of the invention.
Figure 7:
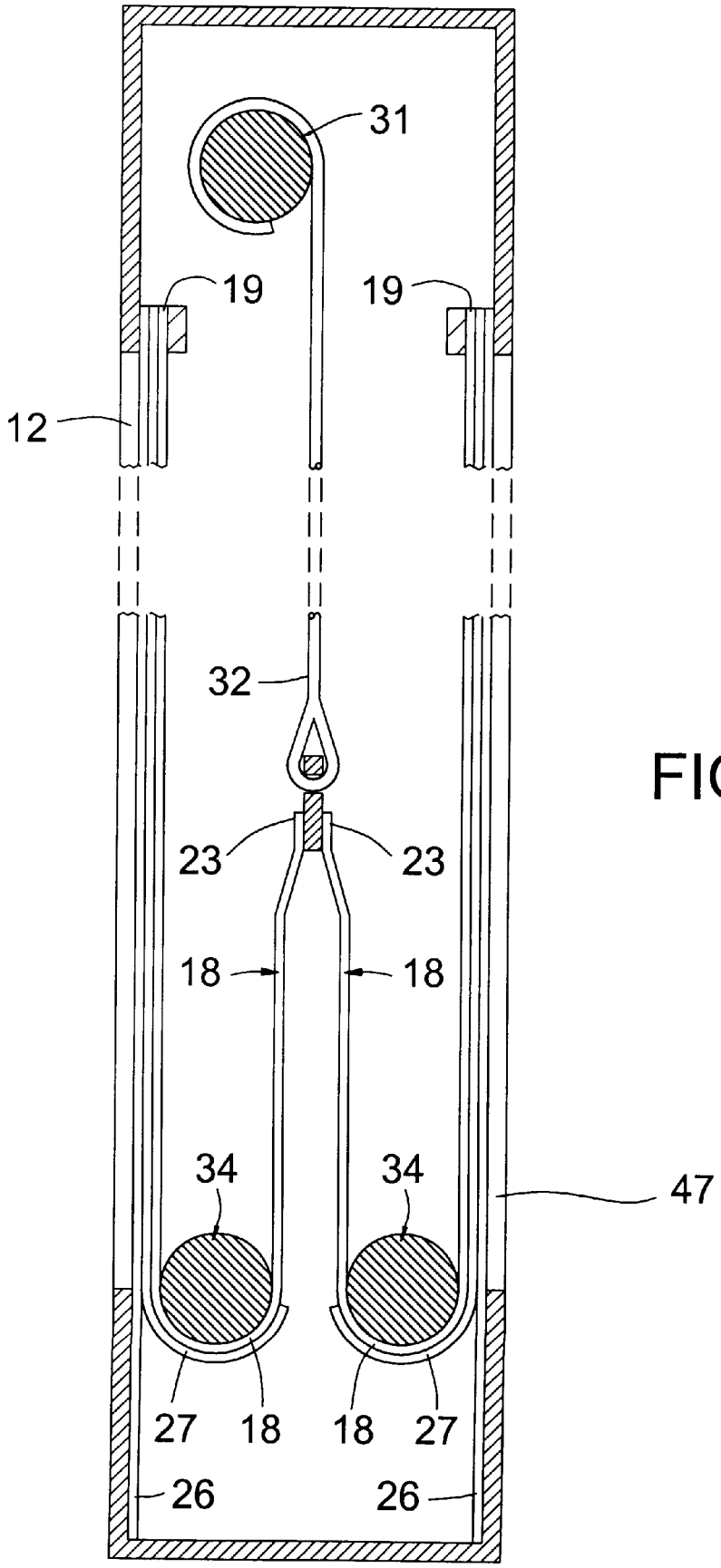
FIG. 7 is a vertical sectional view of an alternate embodiment of the invention.
Figure 8:
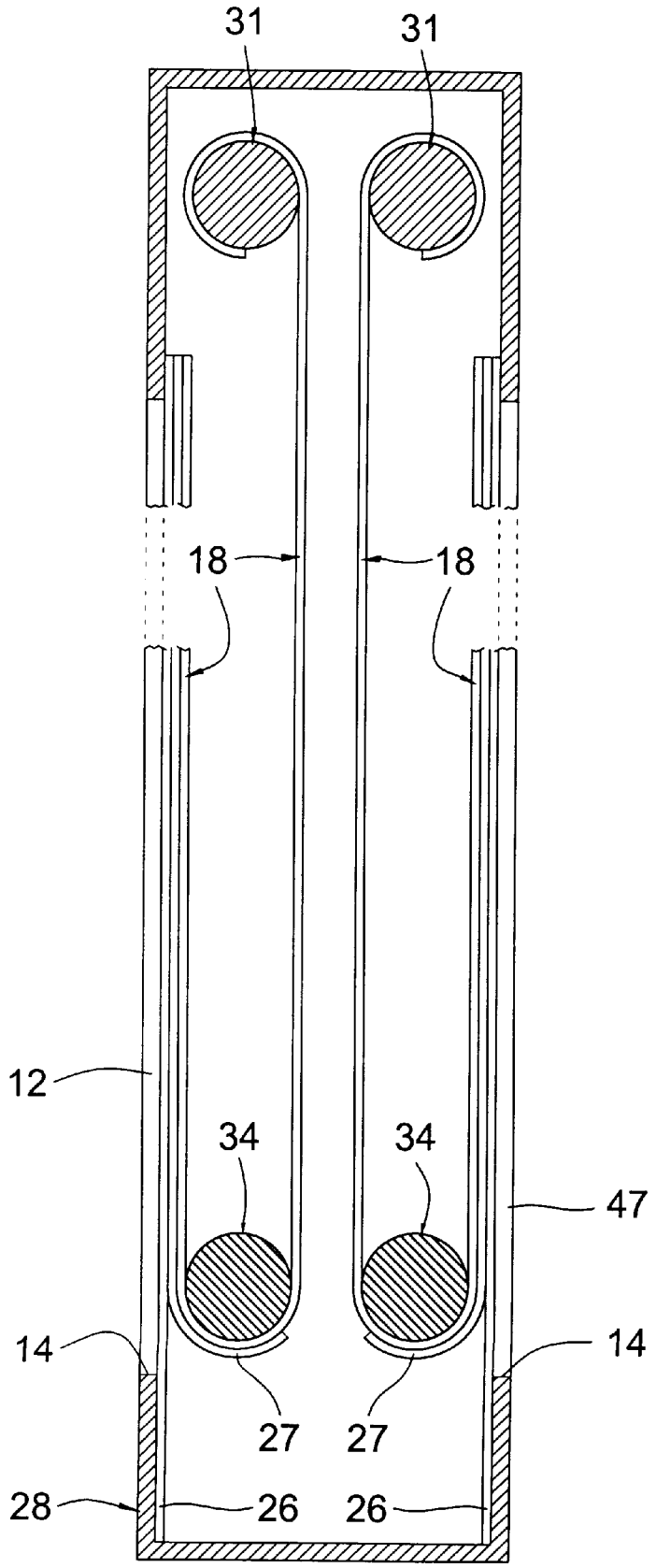
FIG. 8 is a vertical sectional view of an alternate embodiment of the invention.

In another alternate embodiment shown in FIGS. 6–8, a dual curtain assembly includes channel members 28 and 29 wherein each channel member has two angled surfaces 30 and 46, one for engaging the end of each rod. In this embodiment, there are two curtains 18, two rods 34 having rollers 35 mounted on the ends, and four sets of complementary closure members 26 and 27, with closure members 26 utilized with the curtain farthest from the portal being mounted on the channel members. The angled surfaces 46 for engaging the rod farthest from the portal are angled away from the portal to bias rod 34 towards the outer portions 47 of the channel members to effect a proper seal. The second ends 23 of the two curtains 18 can be attached to a single take-up pipe 31, illustrated in FIG. 7, or they can be attached independently to two separate take-up pipes 31, illustrated in FIG. 8. As pipe(s) 31 rotate(s) to vary the length of curtains 18, rods 34 urge closure members 26 and 27 into sealing engagement. If two take-up pipes are present, pipes 31 can be independently driven such that both curtains 18 can be raised or lowered at the same time, or in the alternative, one curtain can be raised while the other is lowered. This dual curtain design may become useful where the curtains are comprised of different materials suitable for different purposes and it is desirous to block various elements at the same or different times, such as sunlight only, sunlight and wind, wind only, wind and rain, etc.

The control mechanism may be any of a number of mechanisms depending on the needs of the application of the invention. For example, in a livestock confinement house where temperature control is a necessity, the present invention may be used as a cover for a ventilation fan, and as a variable height curtain over a window. In this situation a temperature controller may be attached to each motor for each curtain and constantly monitor the temperature in the house. In this manner, the fans may be uncovered and actuated, and the curtain raised or lowered to meet specific airflow conditions. In another example, the present invention may be used in a greenhouse, having a need to control the amount of sunlight on certain plants during particular months. In this situation, the motor may be controlled by a timer or may be connected to a sensing system connected to a plurality of photocells that incrementally indicate to the motor how much of the curtain should be raised or lowered. Likewise, the opening can be monitored to close during a rain shower. In the simplest case a switch to turn the motor on and off may be provided. Furthermore, limit switches of various kinds may be placed at various locations to further control the movement of the curtain, such that it may eliminate air curtains or the like.

It is ostensibly noteworthy to mention that the present invention is not limited to vertical portals, but can be used with portals ranging from vertical to horizontal or any angle therebetween. Additionally, the present invention is not susceptible to sliding friction between the parts because all of the mating surfaces are contacting each other in a rolling relationship. Therefore, wear on the curtain is minimized, and the drive units do not have to overcome friction to position the curtain. Furthermore, the curtain is not susceptible to jamming due to debris being wedged into sliding engagement with a component since no sliding movement is provided. Accordingly, we have developed a roll-up curtain system that is amenable to a variety of uses in numerous applications from residential to commercial to botanical to agricultural.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. Apparatus for covering and uncovering a portal, comprising in combination:

a) a flexible curtain having elongated side portions, and first and second ends each having a dimension commensurate with the separation of lateral margins of the portal, said first end of said curtain being fixedly attached across the portal at a first end thereof, said second end of said curtain being folded back on itself to define a pocket opening toward said first end of said curtain;

b) an elongated rod captured within said pocket;

c) means attached adjacent said lateral margins for holding opposing ends of said rod therein such that said rod may travel freely in a direction parallel to the plane of said lateral margins but is substantially prevented from movement normal to the plane of said lateral margins, wherein said holding means comprises surfaces angled towards said lateral margins for engaging said ends of said rod to bias said rod towards said lateral margins; and, d) means for urging said second end of said curtain along a path parallel to the plane of said lateral margins such that said pocket is positioned at selected positions.

2. Apparatus according to claim 1, further comprising means for releasably and repeatedly attaching said elongated side portions to said lateral margins concomitantly with positioning said pocket at selected positions.

3. Apparatus according to claim 2, wherein said attaching means comprises hook and loop fasteners cooperatively affixed to said elongated side portions and said lateral margins.

4. Apparatus according to claim 1, further comprising means for releasably and repeatedly attaching said elongated side portions to said holding means concomitantly with positioning said pocket at selected positions.

5. Apparatus according to claim 4, wherein said attaching means comprises hook and loop fasteners cooperatively affixed to said elongated side portions and said holding means.

6. Apparatus according to claim 1, wherein each end of said rod comprises a spring loaded roller for engaging one of said angled surfaces of said holding means.

7. Apparatus according to claim 6, wherein said roller comprises an angled surface corresponding to said one of said angled surfaces.

8. Apparatus according to claim 1, further comprising:

a) a pair of elongated flexible strips, wherein each strip comprises first and second side portions, said first side portions being fixedly attached to said holding means; and.

b) means for releasably and repeatedly attaching said elongated side portions of said curtain to said second side portions of said flexible strips concomitantly with positioning said pocket at selected positions.

9. Apparatus according to claim 8, wherein said attaching means comprises hook and loop fasteners cooperatively affixed to said elongated side portions of said curtain and said second side portions of said flexible strips.

10. Apparatus according to claim 1, further comprising:

a) a second flexible curtain mounted parallel to the first curtain, said second curtain having elongated side portions, and first and second ends each having a dimension commensurate with the separation of said lateral margins, said first end of said second curtain being fixedly attached across the portal at said first end thereof, said second end of said second curtain being folded back on itself to define a second pocket opening toward said first end of said second curtain; and, b) a second elongated rod captured within said second pocket, wherein the opposing ends of said second rod are held within said holding means such that said second rod may travel freely in a direction parallel to the plane of said lateral margins but is substantially prevented from movement normal to the plane of said lateral margins, wherein said holding means further comprises surfaces angled away from said lateral margins for engaging said ends of said second rod to bias said second rod away from said lateral margins.

11. Apparatus according to claim 10, wherein said urging means advances said second end of said second curtain along a path parallel to the plane of said lateral margins concomitantly with said second end of said first curtain such that said pockets of said first and second curtains are positioned at selected positions.

12. Apparatus according to claim 10, further comprising second means for urging said second end of said second curtain along a path parallel to the plane of said lateral margins such that said second pocket is positioned at selected locations.

13. Apparatus according to claim 10, further comprising second attaching means for releasably and repeatedly attaching said elongated side portions of said second curtain to said holding means concomitantly with positioning said second pocket at selected positions.

14. Apparatus according to claim 10, wherein each end of said second rod comprises a spring loaded roller for engaging one of said angled surfaces.

15. Apparatus according to claim 10, further comprising:

a) a second pair of elongated flexible strips, wherein each strip comprises first and second side portions, said first side portions being fixedly attached to said holding means; and, b) means for releasably and repeatedly attaching said elongated side portions of said second curtain to said second side portions of said second pair of flexible strips concomitantly with positioning said second pocket at selected positions.

16. Apparatus according to claim 15, wherein said attaching means comprises hook and loop fasteners cooperatively affixed to said elongated side portions of said second curtain and said second side portions of said second pair of flexible strips.

17. Apparatus for covering and uncovering a portal, comprising in combination:

a) a flexible curtain having elongated side portions, and first and second ends each having a dimension commensurate with the separation of lateral margins of the portal, said first end of said curtain being fixedly attached across the portal at a first end thereof;

b) an elongated rod fixedly attached to said second end of said curtain;

c) means attached adjacent said lateral margins for holding opposing ends of said rod therein such that said rod may travel freely in a direction parallel to the plane of said lateral margins but is substantially prevented from movement normal to the plane of said lateral margins, wherein said holding means comprises surfaces angled toward said lateral margins for engaging said ends of said rod to bias said rod toward said lateral margins;

and, d) means for rotatably urging said rod along a path parallel to the plane of said lateral margins such that said rod is positioned at selected positions.

18. Apparatus according to claim 17, further comprising means for releasably and repeatedly attaching said elongated side portions to said lateral margins concomitantly with positioning said rod at selected positions.

19. Apparatus according to claim 18, wherein said attaching means comprises hook and loop fasteners cooperatively affixed to said elongated side portions and said lateral margins.

20. Apparatus according to claim 17, wherein each end of said rod comprises a spring loaded roller for engaging one of said angled surfaces of said holding means.

21. Apparatus according to claim 20, wherein said roller comprises an angled surface corresponding to said one of said angled surfaces.

22. Apparatus for sealably covering and uncovering a portal, comprising in combination:

a) a flexible curtain having elongated side portions, and first and second ends each having a dimension commensurate with the separation of lateral margins of the portal, said first end of said curtain being fixedly attached across the portal at a first end thereof, said second end of said curtain being folded back on itself to define a pocket opening toward said first end of said curtain;

b) an elongated rod captured within said pocket;

c) a pair of elongated flexible strips, wherein each strip comprises first and second side portions, said first side portions being fixedly attached to said lateral margins;

d) means for releasably and repeatedly attaching said elongated side portions of said curtain to said second side portions of said flexible strips concomitantly with positioning said pocket at selected positions; and, e) means for urging said second end of said curtain along a path parallel to said lateral margins such that said pocket is positioned at selected positions.

23. Apparatus according to claim 22, further comprising means fixedly attached to said lateral margins for holding opposing ends of said rod therein such that said rod may travel freely in a direction parallel to the plane of said lateral margins but is substantially prevented from movement normal to the plane of said lateral margins.

24. Apparatus according to claim 23, wherein said first side portions of said flexible strips are fixedly attached to said holding means.

25. Apparatus according to claim 22, wherein said attaching means comprises hook and loop fasteners cooperatively affixed to said elongated side portions of said curtain and said second side portions of said flexible strips.

26. Apparatus for sealably covering and uncovering a portal, comprising in combination:

a) a flexible curtain having elongated side portions, and first and second ends each having a dimension commensurate with the separation of lateral margins of the portal, said first end of said curtain being fixedly attached across the portal at a first end thereof;

b) an elongated rod fixedly attached to said second end of said curtain;

c) a pair of elongated flexible strips, wherein each strip comprises first and second side portions, said first side portions being fixedly attached to said lateral margins;

d) means for rotatably urging said rod along a path parallel to the plane of said lateral margins such that said rod is positioned at selected positions;

and, e) means for releasably and repeatedly attaching said elongated side portions of said curtain to said second side portions of said flexible strips concomitantly with positioning said rod at selected positions.

27. Apparatus according to claim 26, further comprising means fixedly attached to said lateral margins for holding opposing ends of said rod therein such that said rod may travel freely in a direction parallel to the plane of said lateral margins but is substantially prevented from movement normal to the plane of said lateral margins.

28. Apparatus according to claim 27, wherein said first side portions of said flexible strips are fixedly attached to said holding means.

29. Apparatus according to claim 26, wherein said attaching means comprises hook and loop fasteners cooperatively affixed to said elongated side portions of said curtain and said second side portions of said flexible strips.

30. Apparatus for sealably covering and uncovering a portal, comprising in combination:

a) a flexible curtain having elongated side portions, and first and second ends each having a dimension commensurate with the separation of lateral margins of the portal, said first end of said curtain being fixedly attached across the portal at a first end thereof;

b) a pair of elongated flexible strips, wherein each strip comprises first and second side portions, said first side portions being fixedly attached to said lateral margins;

c) means for urging said second end of said curtain along a path parallel to the plane of said lateral margins such that said second end of said curtain is positioned at selected positions; and, d) means for releasably and repeatedly attaching said elongated side portions of said curtain to said second side portions of said flexible strips concomitantly with positioning said second end of said curtain at selected positions.

31. Apparatus according to claim 30, further comprising an elongated rod fixedly attached to said second end of said curtain.

32. Apparatus according to claim 31, further comprising means fixedly attached to said lateral margins for holding opposing ends of said rod therein such that said rod may travel freely in a direction parallel to the plane of said lateral margins but is substantially prevented from movement normal to the plane of said lateral margins.

33. Apparatus according to claim 32, wherein said first side portions of said flexible strips are fixedly attached to said holding means.

34. Apparatus according to claim 30, further comprising a channel formed within each of said second side portions of said flexible strips for receiving a rigid support member therein, wherein said rigid support member imparts rigidity to said flexible strips to promote detachment of said elongated side portions from said flexible strips as said second end of said curtain is positioned at selected positions.

* * * * *